US007174675B2

(12) United States Patent
Araneva et al.

(10) Patent No.: US 7,174,675 B2
(45) Date of Patent: Feb. 13, 2007

(54) FINGER GUARD

(75) Inventors: Veikko Araneva, Hyvinkaa (FI); Ari Ketonen, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/211,581

(22) Filed: Aug. 5, 2002

(65) Prior Publication Data

US 2003/0005642 A1 Jan. 9, 2003

Related U.S. Application Data

(63) Continuation of application No. PCT/FI01/00186, filed on Feb. 22, 2001.

(30) Foreign Application Priority Data

Feb. 22, 2000 (FI) ..... 20000408

(51) Int. Cl.
*E05D 15/16* (2006.01)

(52) U.S. Cl. ..... 49/406; 49/460

(58) Field of Classification Search ..... 49/406, 49/460, 462, 366, 370; 187/333
See application file for complete search history.

(56) References Cited

U.S. PATENT DOCUMENTS 1,611,705 A * 12/1926 Zivert ..... 49/406
5,092,079 A * 3/1992 Brookman et al. ..... 49/462
5,540,302 A * 7/1996 Nagasawa et al. ..... 49/475.1
5,794,745 A 8/1998 Gore

FOREIGN PATENT DOCUMENTS

| | | | | |
|---|---|---|---|---|
| GB | 2298887 | * | 9/1966 | ..... 49/460 |
| GB | 2 244 751 | A | 12/1991 | |
| JP | 53-128840 | | 11/1978 | |
| JP | 8-259160 | A | 10/1996 | |
| WO | 00/50331 | A1 | 8/2000 | |

* cited by examiner

*Primary Examiner*—Jerry Redman
(74) *Attorney, Agent, or Firm*—Birch, Stewart, Kolasch, and Birch, LLP

(57) ABSTRACT

A finger guard for preventing fingers from getting into the gap between a sliding door of an elevator and a stop surface of a profiled edging strip. A profiled fillet forming the finger guard comprises an elastic tongue extending from the profiled edging strip obliquely outward toward the surface of the sliding door and a supporting element disposed in the gap to keep the tongue clear of and at a distance from the surface of the sliding door.

18 Claims, 3 Drawing Sheets

FINGER GUARD

This application is a Continuation of copending PCT International Application No. PCT/FI01/00186 filed on Feb. 22, 2001, which was published in English and which designated the United States and on which priority is claimed under 35 U.S.C. § 120, the entire contents of which are hereby incorporated by reference.

FIELD OF THE INVENTION

The present invention relates to a finger guard.

DESCRIPTION OF THE BACKGROUND ART

Especially small children, who cannot watch out and have small fingers, run the risk of accidentally inserting their fingers into the chink of an elevator door, i.e. into the gap between two door panels sliding with respect to each other or between a door panel and the door frame. The width of such a chink or gap is typically 5–6 mm, and a smaller gap is difficult to achieve because the tolerances required in manufacture and operation do not allow it.

To solve this problem, light cells and other electric sensors have been used. A drawback with these is that they involve delays, as a result of which the door can not stop in time. Moreover, in a critical situation they may fail to function reliably. In particular, the large weight of glass doors involves a special risk as they continue moving by virtue of their mass even if the sensors should have responded. Sensors are also subject to vandalism as they are exposed to sight and susceptible to malicious damage or interference. Therefore, they also involve significant maintenance and repair costs.

A prior-art solution is also presented in patent specification U.S. Pat. No. 5,794,745. The finger guard according to this patent comprises a brush-like strip attached to the edge of the door frame on the side facing toward the door opening, which strip, being mounted in an obliquely outward directed orientation against the door surface, covers and closes the gap between the door and the frame at least from direct sight. This solution does not prevent fingers from getting into the gap but only arouses the person to quickly draw his/her hand away if the fingers touch the brush. Another disadvantage in this solution is surface-mounted installation and visibility of the structure, which means that it is susceptible to damage and vandalism. Moreover, the structure reduces the size of the door opening especially if the doors can move to a position completely outside or flush with the door opening delimited by the frame. Besides, this structure is difficult to apply between two door panels because in that case it directly reduces the size of the door opening and forms edges or flanges that may catch elevator passengers or objects carried along.

BRIEF SUMMARY OF THE INVENTION

The object of the invention is to eliminate the above-mentioned problems. A specific object of the invention is to disclose a finger guard for elevator doors that is as invisible and inconspicuous and as possible and yet completely prevents fingers from getting into the gap between a sliding door of an elevator and the stop face of a profiled edging strip.

The finger guard of the invention consists of a profiled fillet extending over the length of the gap to be guarded, preventing fingers from getting into the gap between a sliding door of an elevator and the stop face of a profiled edging strip. According to the invention, the profiled fillet forming the finger guard comprises an elastic tongue extending from the profiled edging strip obliquely outward toward the opening doorway and toward the surface of the sliding door and a supporting element disposed in the gap between the sliding door and the profiled edging strip stop face and designed to keep the tongue clear of and at a distance from the surface of the sliding door.

The finger guard of the invention can be placed on the profiled edging strip mounted on the edge of a door opening, i.e. in practice in the gap between a door frame and a sliding door. It can also be placed in the gap between the profiled edging strip at one edge of a sliding door and another door panel slidable in relation to it.

The supporting element used is preferably a rigid brush, i.e. a supporting surface provided with parallel hairs which is pressed against the door surface. Of course it is possible to use various rollers, wheels or equivalent rotating elements or suitable sliding surfaces as a supporting element. However, a suitable brush has been found to be the cheapest solution and easiest to use. The essential point about the supporting element is that it keeps the tongue all the time clear of the door surface. The supporting element itself may be continuously in contact with the door surface, but preferably it is so arranged that it will only occasionally, i.e. when necessary, touch the door surface.

The elastic tongue comprised in the profiled finger guard fillet, which is preferably made of a suitable rubber or plastic material, preferably extends nearly completely across the gap to be guarded, in other words, it extends to a distance of about 0.2–2 mm, preferably about 1 mm from the surface of the door. Expressed in more definite terms, the supporting surface of the supporting element always stands out farther from the surface of adhesion of the finger guard fillet than the elastic tongue. This difference in the extent of protrusion is preferably of the order of 1 mm. Thus, the end of the tongue can not chafe the door surface and undergoes no wear but will only bend against the door surface and respond in an actual guarding situation.

The elastic tongue of the invention is preferably disposed alongside the supporting element, in the gap between the sliding door and the profiled edging strip, so that the entire finger guard is substantially hidden from sight. Thus, the elastic tongue does not reduce the size of the door opening and cannot be easily damaged. However, it is also possible that, with the supporting element placed in the gap, the elastic tongue extends at least somewhat outside the gap.

The elastic tongue may consist of a flange of a substantially uniform thickness, but the extreme edge of the tongue near the door surface is preferably provided with a rounded edge bellying which stiffens the edge zone of the tongue. It also ensures that, as the tongue responds when hit by a finger, it does not yield but pushes the fingers off the surface of the sliding door, thus preventing them from getting into the gap. To ensure this function, the elastic tongue preferably forms an angle below 45° with the surface of the sliding door. A suitable value of the angle is e.g. about 35°.

In an embodiment of the invention, the finger guard comprises an auxiliary tongue disposed behind the elastic tongue, i.e. between the elastic tongue and the supporting element, said auxiliary tongue constituting a backing structure substantially more rigid than the elastic tongue, designed to prevent excessive inward bending of the elastic tongue, thus ensuring that the finger guard can function properly.

The finger guard of the invention works as follows. If fingers touching the door surface hit the finger guard, i.e. its elastic tongue, the tongue will turn somewhat inward and push the fingers off the surface, preventing them from getting into the gap. If one tries to push the elastic tongue inward by force, the auxiliary tongue will prevent the elastic tongue from bending further inward and force the fingers clear of the door surface. Thus, the finger guard functions as a kind of finger plow.

As compared with prior art, the finger guard of the invention has significant advantages. The finger guard has a very simple structure and is reliable in operation, so it is advantageous in respect of both installation and use. In addition, in spite of its good performance, the finger guard can be so mounted as to be almost completely hidden from sight, so it does not reduce the size of the door opening or impede passage through the door opening in any way, nor is it susceptible to vandalism. A further advantage is that the finger guard is easy to retrofit in elevators already in use.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to the drawings, which are given by way of illustration only, and thus are not limitative of the present invention, and wherein.

DETAILED DESCRIPTION OF THE INVENTION

Figure 1:
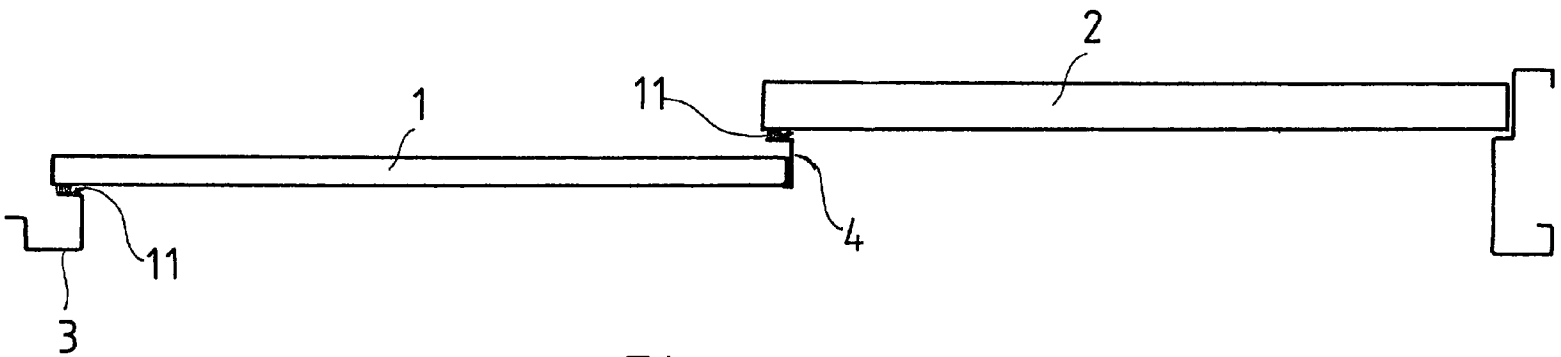
FIG. 1 is generalized illustration of applications of the invention.

As illustrated in FIG. 1, the finger guard 11 of the invention can be used in the gap between a profiled edging strip 3 mounted at the edge of a door opening and a sliding door 1, and between a profiled edging strip 4 mounted on the other edge of the sliding door 1 and another door panel 2.

Figure 2:
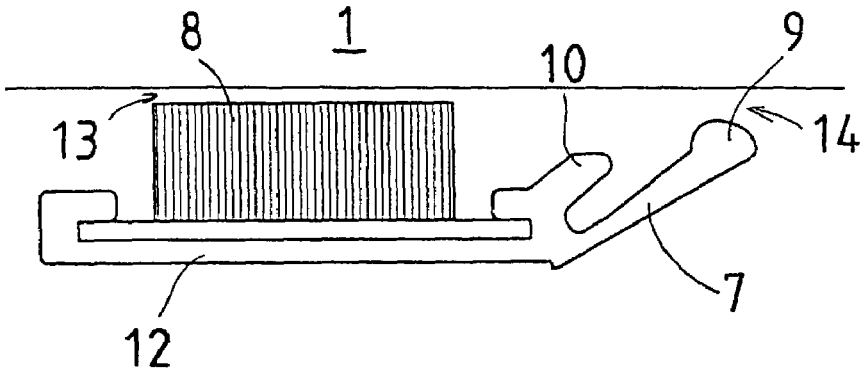
FIG. 2 presents a finger guard according to the invention.

FIG. 2 presents a finger guard according to the invention, consisting of a profiled fillet with a substantially even and plate-like stem 12. The stem 12 may be provided with a suitable self-adhesive surface, which can be used to glue it fast on an appropriate profiled edging strip in the place of application. Fixed on top of the stem is a brush-like supporting element 8, and at one edge of the stem there are two flange-like elements extending obliquely upward at an angle of about 35°.

The outer, elastic tongue 7 extends higher up to a level near the upper level determined by the brush-like supporting element 8. The extremity of the tongue 7 consists of a round-shaped edge bellying 9. An auxiliary tongue 10 shorter and more rigid than the elastic tongue 7 is placed between the elastic tongue 7 and the brush 8. It may be of the same material with the elastic tongue 7, but as its thicker and shorter, it is substantially more rigid than the elastic tongue. As can be seen from the figure, the gap 13 between the surface of the door 1 and the brush 8 is always smaller than the corresponding gap 14 at the end of the tongue 7, so when the brush 8 touches the door surface, the tongue will remain at a distance from the door surface.

Figure 2A:
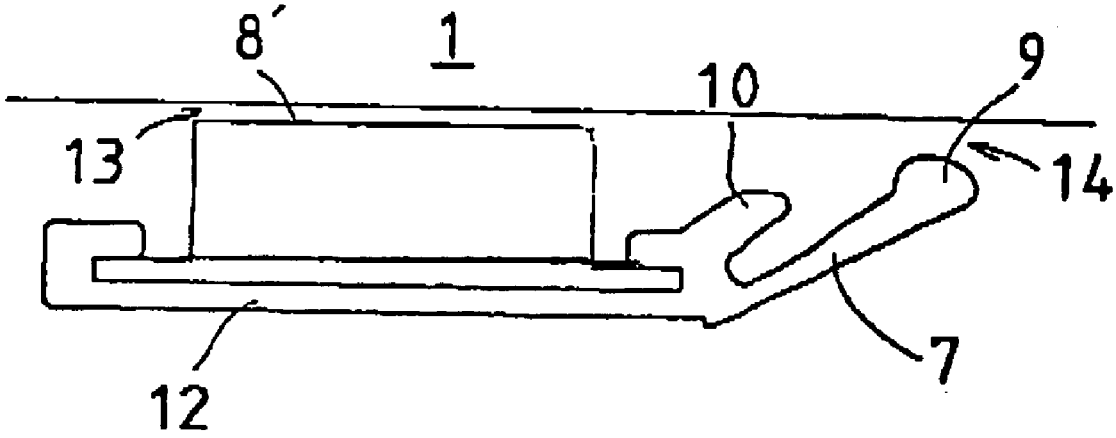
FIG. 2*a* presents a finger guard with a modified supporting element.

FIG. 2*a* shows the finger guard of FIG. 2, but with a different supporting element 8'. This supporting element can be a sliding bearing or a roller bearing which either continuously or intermittently touches the surface of the sliding door.

Figure 3:
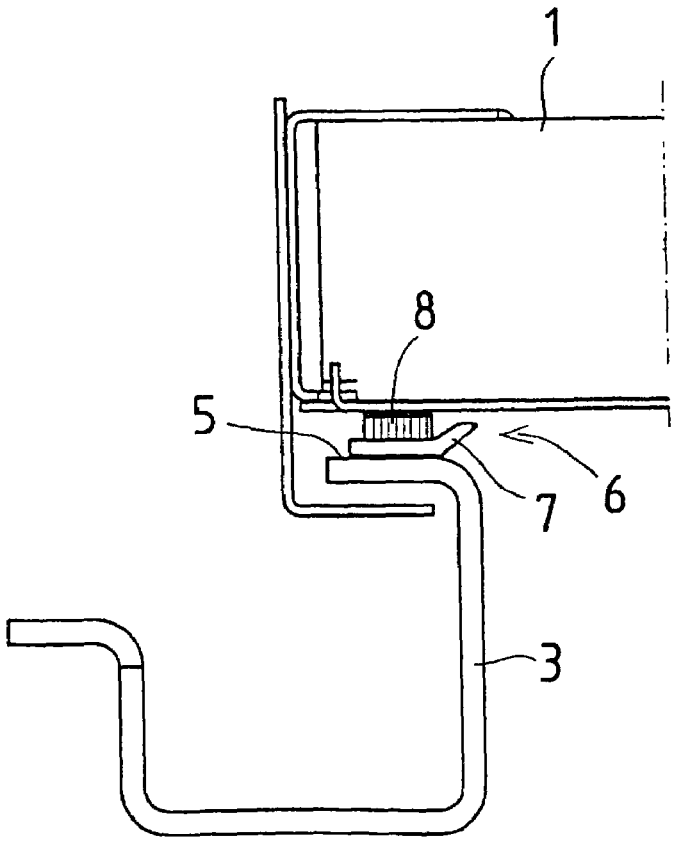
FIG. 3 presents another finger guard according to the invention, installed in its place of application.

FIG. 3 presents another embodiment of the invention, which in its basic structure substantially corresponds to the embodiment in FIG. 2. Thus, the finger guard comprises a profiled finger guard fillet placed in the gap 6 between a profiled edging strip 3 and a door 1 and fixed to a stop face 5 of the profiled edging strip. The profiled fillet is provided with a brush 8, which may lean on the surface of the door 1 and thus determine the width of the gap 6. However, the gap 6 may also be wider than the width determined by the brush 8, in which case the brush only sometimes touches the door surface and sometimes a small gap remains between the brush and the door surface.

In addition, the profiled fillet has an oblique elastic tongue 7 extending toward the outer edge of the gap 6 and toward the surface of the door 1. The tongue 7 has a substantially uniform thickness and it does not extend to the surface of the door 1; instead, its edge remains at a suitable small distance from the surface regardless of whether the brush is touching the door surface or whether it is at a distance from it. This distance is e.g. about 1 mm.

In both embodiments presented in FIGS. 2 and 3, the elastic tongue 7 works in substantially the same way, performing a "plowing" action and forcing a finger touching the door surface clear of it, thus preventing the finger from getting into the gap between the profiled edging strip and the door. In the embodiment in FIG. 2, this function is additionally enhanced by the design of the edge of the tongue 7 and an auxiliary tongue 10 placed behind it.

In the foregoing, the invention has been described by way of example with reference to the attached drawings while different embodiments of the invention are possible in the scope of the inventive idea defined in the claims.

The invention claimed is:

1. A finger guard mounted in a gap between a sliding door of an elevator and the stop surface of a profiled edging strip comprising:

an elastic tongue extending from the profiled edging strip obliquely outward toward and spaced from a surface of the sliding door; and a supporting element disposed in the gap to keep the tongue clear of and at a distance from the surface of the sliding door;

whereby fingers are prevented from getting into the gap;

an auxiliary tongue between the elastic tongue and the supporting element, the auxiliary tongue prevents the elastic tongue from turning too far toward the auxiliary tongue.

2. The finger guard as defined in claim 1, wherein the profiled edging strip is placed at an edge of the door opening.

3. The finger guard as defined in claim 1, wherein the profiled edging strip is placed at an edge of the sliding door.

4. The finger guard as defined in claim 1, wherein the supporting element is a brush chafing the surface of the sliding door one of intermittently and continuously.

5. The finger guard as defined in claim 1, wherein the supporting element is one of a sliding bearing and a roller bearing touching the surface of the sliding door one of intermittently and continuously.

6. The finger guard as defined in claim 1, wherein the elastic tongue is spaced a distance of 0.5–2 mm from the surface of the sliding door.

7. The finger guard as defined in claim 1, wherein the elastic tongue is spaced a distance of 1 mm from the surface of the sliding door.

8. The finger guard as defined in claim 1, wherein the elastic tongue is placed in the gap between the sliding door and a stop face of the profiled edging strip.

9. The finger guard as defined in claim 1, wherein the elastic tongue includes a rounded, enlarged end.

10. The finger guard as defined in claim 1, wherein the elastic tongue forms an angle of less than 45° with the surface of the sliding door.

11. The finger guard as defined in claim 1, wherein the elastic tongue forms an angle of less than 35° with the surface of the sliding door.

12. The finger guard as defined in claim 1, wherein the auxiliary tongue is substantially parallel to and spaced from the elastic tongue.

13. The finger guard as defined in claim 1, wherein the auxiliary tongue is substantially more rigid than the elastic tongue.

14. The finger guard as defined in claim 1, wherein the supporting element includes a brush, the auxiliary tongue being between the brush and the elastic tongue and the brush, the auxiliary tongue and the elastic tongue facing the surface of the sliding door.

15. The finger guard as defined in claim 1, wherein the surface of the sliding door is uniformly smooth and flat.

16. A finger guard mounted in a gap between a sliding door of an elevator and a stop surface of a profiled edging strip, comprising:

means for urging a finger from the gap when the sliding door is closing;

the means for urging includes:

an elastic tongue extending from the profiled edging strip obliquely outward toward a surface of the sliding door; and a supporting element disposed in the gap to keep the tongue clear of and at a distance from the surface of the sliding door;

whereby fingers are prevented from getting into the gap;

an auxiliary tongue substantially parallel to and spaced from the elastic tongue, the auxiliary tongue prevents the elastic tongue from turning too far toward the auxiliary tongue.

17. A finger guard mounted in a gap between a sliding door of an elevator and the stop surface of a profiled edging strip comprising:

means for urging a finger from the gap when the sliding door is closing; the means for urging includes:

an elastic tongue extending from the profiled edging strip obliquely outward toward a surface of the sliding door; and a supporting element disposed in the gap to keep the tongue clear of and at a distance from the surface of the sliding door;

whereby fingers are prevented from getting into the gap;

an auxiliary tongue between the elastic tongue and the supporting element, the auxiliary tongue prevents the elastic tongue from turning too far toward the auxiliary tongue.

18. The finger guard as defined in claim 17, wherein the auxiliary tongue is substantially more rigid than the elastic tongue.

* * * * *